United States Patent [19]

Bock et al.

[11] Patent Number: 4,882,996

[45] Date of Patent: Nov. 28, 1989

[54] EXPLOSIVE PROJECTILE ASSEMBLY WITH A PROJECTILE BODY

[75] Inventors: Erich Bock, Nurnberg; Rainer Himmert, Lauf, both of Fed. Rep. of Germany

[73] Assignee: Diehl GmbH & Co., Nurnberg, Fed. Rep. of Germany

[21] Appl. No.: 263,725

[22] Filed: Oct. 28, 1988

[30] Foreign Application Priority Data

Oct. 30, 1987 [DE] Fed. Rep. of Germany ..... 3736842

[51] Int. Cl.[4] ..... F42B 13/18

[52] U.S. Cl. ..... 102/496; 102/494; 102/517

[58] Field of Search ..... 102/364, 389, 491–497, 102/517, 522

[56] References Cited

U.S. PATENT DOCUMENTS

| | | | |
|---|---|---|---|
| 94,647 | 9/1869 | Richards | 102/497 |
| 229,499 | 6/1880 | Turner | 102/494 |
| 1,216,364 | 2/1917 | Roger | 102/364 |
| 4,043,269 | 8/1977 | Ambrasini | 102/522 |
| 4,063,508 | 12/1977 | Whiting | 102/497 |
| 4,524,696 | 6/1985 | Altenau et al. | 102/491 |

FOREIGN PATENT DOCUMENTS

| | | | |
|---|---|---|---|
| 68533 | 6/1982 | European Pat. Off. . | |
| 101795 | 5/1983 | European Pat. Off. . | |
| 3424238 | 1/1986 | Fed. Rep. of Germany | 102/493 |

*Primary Examiner*—Harold J. Tudor

*Attorney, Agent, or Firm*—Scully, Scott, Murphy & Presser

[57] ABSTRACT

An explosive missile or projectile assembly which possesses a projectile body and a ballistic hood which is positioned in front of the projectile body, wherein the hood encompasses a head end portion of the projectile body, and which includes an explosive charge arranged within the projectile body and a base detonator. An in-depth effect and fragmentation effect comes into bearing in the direction of firing, in that fragments are arranged intermediate the head end portion of the projectile body and the ballistic hood, and in which the projectile body is equipped with performed fragments.

12 Claims, 4 Drawing Sheets

EXPLOSIVE PROJECTILE ASSEMBLY WITH A PROJECTILE BODY

BACKGROUND OF THE INVENTION

1. Field of the Invention

The present invention relates to an explosive missile or projectile assembly which possesses a projectile body and a ballistic hood which is positioned in front of the projectile body, wherein the hood encompasses a head end portion of the projectile body, and which includes an explosive charge arranged within the projectile body and a base detonator.

2. Discussion of the Prior Art

From the disclosure of European Patent No. 0 068 533 there has become known a particular explosive incendiary grenade. This grenade possesses a projectile body and a ballistic hood which is mounted in front of the projectile body. With the projectile body there is provided an explosive charge, and with an incendiary charge being arranged ahead of the explosive charge. A base detonator is located rearwardly of the explosive charge. The explosive charge possesses a conical tip at its leading end, and this tip is encompassed by an incendiary charge, in which the incendiary charge is arranged within a conical recess in the projectile body. Through the utilization of this arrangement, the incendiary charge is dispersed over a relatively wide space due to the action of the explosive charge.

Furthermore, an explosive projectile possessing a fragmentation effect has become known from the disclosure of European Patent No. 0 101 795. Preformed fragments are arranged in the projectile body, as well as in the rearward portion of a nose fuze. These fragment member are accelerated by means of a suitably associated booster charge into the spatial angle sectors which are located directly in front of the head end of the projectile. However, in that instance, it is disadvantageous that the nose fuze which disintegrates during the detonation of the explosive charge provides an obstruction to the spread of the fragments in the forward angle sector.

SUMMARY OF THE INVENTION

Accordingly, it is an object of the present invention to provide an explosive fragmentation projectile assembly which is embued with an in-depth effect in a target, in which the fragmentation effect also comes into bearing in the direction of firing.

The foregoing object is achieved through the intermediary of an explosive missile as described herein, in that fragments are arranged intermediate the head end portion of the projectile body and the ballistic hood, and in which the projectile body is equipped with preformed fragments.

Further advantageous embodiments of the invention can be ascertained from the following description of preferred embodiments as set forth in detail hereinbelow.

The inventive explosive missile or projectile is adapted for tank cannons at a battle distance of approximately 3,500 meters, and for the attacking of so called soft and semi-hard (unarmored and medium or lightly-armored) targets. The trajectory of the projectile, in a known manner, possesses practically no deviation in its trajectory at this distance from the target which would bear any weight, providing for the presence of a high hitting accuracy, which is necessary for the attacking of narrowly bounded and smaller-sized targets; for example, such as portable or motorized anti-tank defense systems. Within the target area, which is functionally covered by a suitably configured projectile fuze, there is achieved a high density of fragments in the lateral and especially in the forward region of the projectile. Even for greater combat distances, and the therewith interrelated relatively large deviation of the detonation point from the direction of firing, is there attained a high degree of probability in the destruction of the target.

In accordance with a further aspect of the invention, the characteristic fragments possess a good aerodynamic characteristic and, as a result thereof, a good effect over even greater distances. The size of the fragments is optimized in accordance with the demand for high fragment numbers and fragment density. The matrix allows for a suitable configuring of the fragment members. The binding forces of the matrix are adequate for the assembly and manipulation during assembly without causing any problems. Nevertheless, on the other hand, the binding forces are so low that upon detonation, there is present an unhindered disintegration and, consequently, a uniform dispersion of the preformed fragments. Moreover, due to the matrix, in the fragment members there is then present the necessary stability in shape with regard to the shock caused by loading into the shell chamber of the weapon and during firing.

Pursuant to a further feature of the invention, the space within the hood which is available for the fragment members is utilized to an optimum extent, without adversely influencing the aerodynamic properties of the missile or projectile.

In accordance with a further feature of the invention, the shape of each of the fragment members in the configuration of frusto-conical component allows for a good spatial fragment dispersion with a good in-depth effect.

As disclosed in a further feature of the invention, the planar end surface of each of the fragment members allows for an inexpensive manufacture. The plastic material body, due to the planar end surface of the fragment member, fixes the fragment member in a simple manner within the hood, whereas, on the other hand, the fragment member because its low density extent no influence over either the acceleration of the projectile, nor the dispersion of the fragments or the acceleration of the fragments.

As set forth hereinbelow, there is proposed a fragment member with a considerable effect for use with a so-called projectile with propulsion mechanism. Because of the narrower projectile cross-section; only a relative small volume is available for the fragment members. The selected shape and construction of the fragment member, supported by the higher projectile velocity, supports a high fragment density and fragment velocity at lengthy ranges.

Pursuant to a further feature, which relates to a full-calibered projectile, the explosive generates, in the leading, relatively narrow cylindrical portion, the required radial velocity components for an ideal spatial fragment distribution at a detonation in the air. Moreover, the cylindrical portion affords an additional utilization of the space within the hood; for example, through electronic components, such as; for example, sensors or components for the energy supply to the electronic base detonator. Components of that type, due to the cylindrical section, can be supported and also fastened to the projectile body without being subjected to any acceleration forces.

Pursuant to other aspects of the invention, a conical tip which projects outwardly of the fragment member facilitates the propagation of the pressure wave from the explosive for the early or preliminary disintegration of the hood. In accordance with a further aspect, the full-caliber projectile is adapted for deployment against larger-sized target surfaces.

In accordance with another aspect of the invention, because of the projectile being ballistically more expedient, there can be attained relatively high projectile speeds. As a consequence, it is possible to attack at relatively large distances, narrowly bond, smaller targets at a high hitting accuracy. It is also possible to ensure that the fragment members will be adequately protected against various forces and stresses during the loading into a weapon and during firing.

Furthermore, because of the ballistic hood being constituted of steel, there is afforded that, on the one hand, during the firing of the projectile the fragment members will have their shapes remain intact, while on the other hand, the hood through the formation of relatively large fragments, somewhat in the size of the fragment member, will complete the fragmentation effect of the abovementioned fragment members and of the fragments which are arranged about the projectile circumference.

In accordance with yet another aspect, the available space within the hood is employed for an essential increase in the density of the fragment in the direction of firing.

Important to the invention is the large number of fragments ahead of the end surface of the projectile body, and the relative large-surfaced conical portions of the projectile body. Thereby, during the detonation exclusively in air, meaning, at an average of about 10 meters above ground, the so-called blind fragment region (referring also to the specification and the drawings) is covered by a relatively high density of fragments and fragment energy. The cooperation between the fragment members at the end surface with the jacket of fragments which is arranged about the circumference on the projectile body, produces the presence of a high fragmentation effect over a relatively large spatial angle sector.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1:
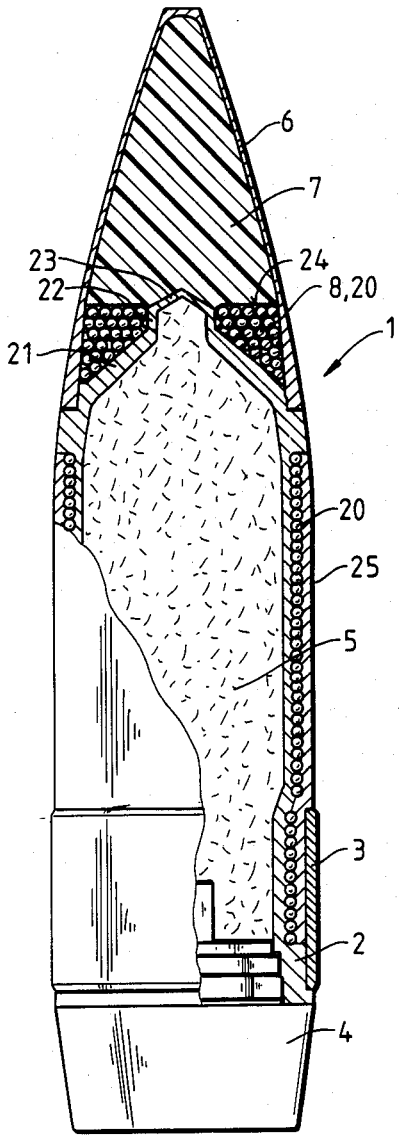
FIG. 1 illustrates a longitudinal partially sectional view through a full-caliber projectile.

As shown in FIG. 1, a missile or projectile 1 which is of a full-caliber configuration, consists of a projectile body 2, a guide band 3, a projectile detonator or fuze 4, an explosive charge 5, a hood 6, a plastic material body 7 constituted from a polyurethane foam, and a fragment member 8.

Spheroids or balls 20 which are constituted from heavy-metal are inserted into a cylindrical section 25 of the projectile body 2. The forwardly closed projectile body, which is shaped as a cone 21, possesses a cylindrical section 22 with a conical tip 23. The wall thickness of the cone 21 reduces with the narrowing diameter. The wall thicknesses reduce further along the cylindrical section 22 towards the tip 23. The fragment member 8 extends between the hood 6, the cone 21, and between the cylindrical section 22. The conical tip 23 projects beyond an end surface 24 of the fragment member 8. The balls 20 of the fragment member 8 are embedded in a matrix which is constituted from a polyurethane foam material.

The plastic material body 7 contacts against the end surface 24 of the fragment member 8, as well as against the internal surface of the hood 6.

The function of the projectile is essentially as follows:

The projectile is fired from a tank cannon (not shown) and flies along a trajectory 26 which subtends an angle 27 of approximately 1° with regard to the horizontal 49.

The projectile 1 detonates over the target area 50 (at a combat distance of approximately 2500 meters) at a height 53 of about 10 meters above ground. The projectile section 25 produces a cone of fragments 31 with an angle or spread of approximately 40°.

The fragment member 8 produces a subsequent cone of fragments 28 with an angle or spread of approximately of 30°. An extremely narrow central region 29 of about 5° in spread evidences relatively few fragments.

The entire region 52 possessing a considerable destructive probability or capability consists of about 75° relative to the horizontal. As a consequence, reached are standing targets, such as vehicles, as well as targets which are covered by an earth embankment 51.

Figure 3:
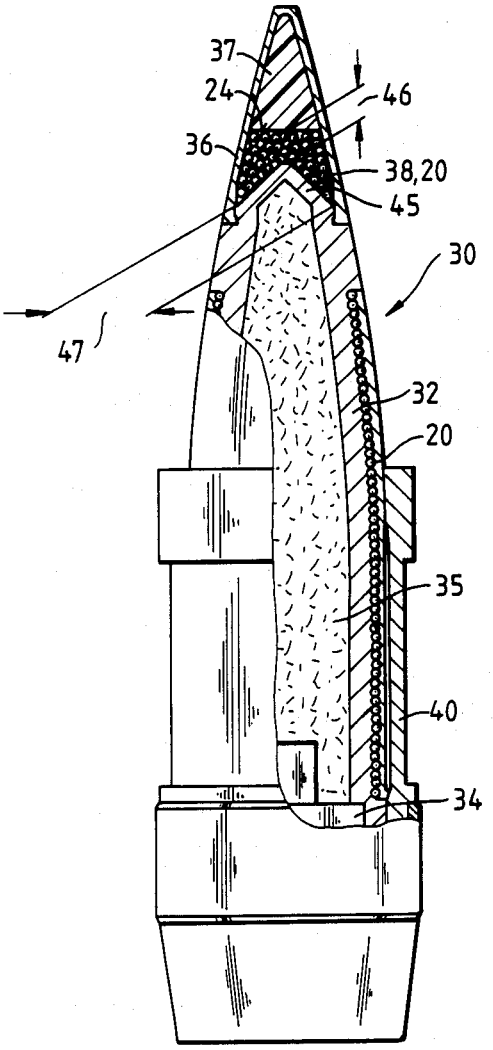
FIG. 3 illustrates a longitudinal, partially sectional view through a sub caliber projectile.

In accordance with FIG. 3, a projectile 30 which is in a sub-caliber configuration, consists of a projectile body 32 with inserted balls or spheroids 20, a base detonator 34, an explosive charge 35, a hood 36, a plastic material body 37 and a fragment member 38.

The projectile body 32 is arranged in a propellent container 40 in a manner known per se.

The projectile body 32 possesses a closed tip in the shape of a cone 45. The fragment member 38 covers the cone 45 completely, and projects beyond the latter by the distance 46 which corresponds to approximately 30% of the external diameter 47 of the fragment member. The remaining volume of the hood 36 is filled by the plastic material body 37 which is constituted from a polyurethane foam.

Figure 2:
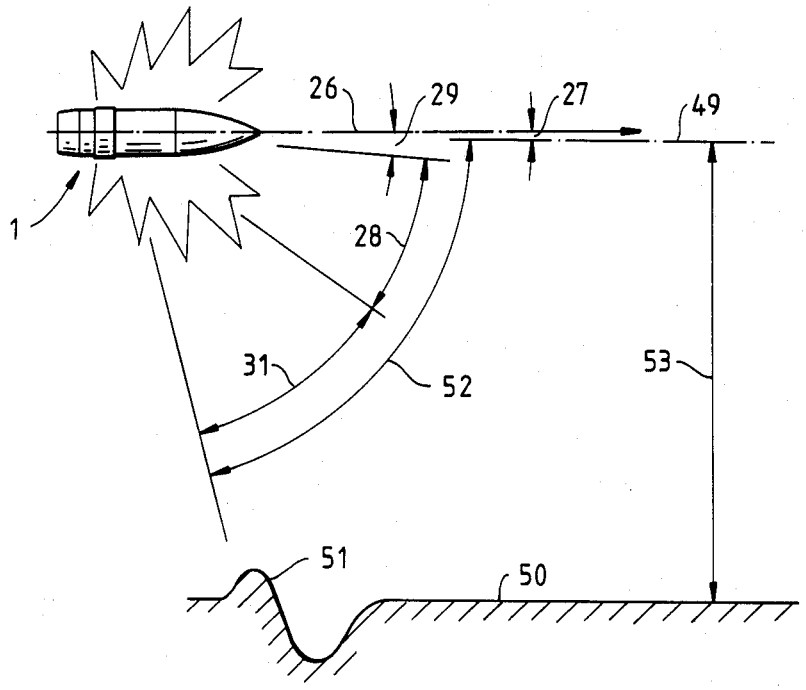
FIG. 2 schematically illustrates, in a diagrammatic manner, the fragmentation effect caused by the projectile of FIG. 1.

The manner of functioning of this projectile corresponds, in principle, with that of the full-caliber projectile 1 which is described with reference to FIG. 2. The corresponding cone of fragments is somewhat narrower. Consequently, the more accurately hitting projectile 30 is deployed against relatively narrowly bounded targets.

Figure 4:
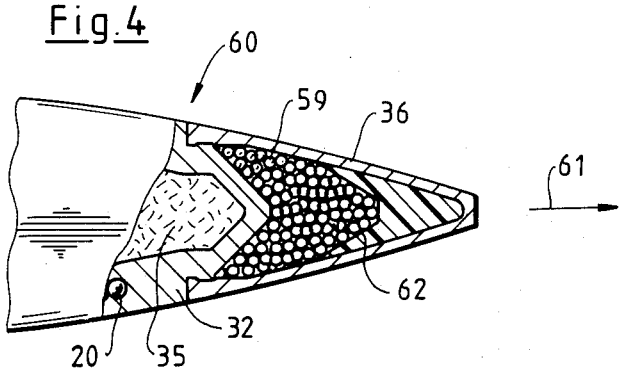
FIG. 4 illustrates a fragmentary portion of another embodiment of a projectile.

Pursuant to FIG. 4, a fragment member 59 of a projectile 6, possesses a narrowing section 62 within the hood 36 in the direction of firing 61. This section 62 has the shape of a cone which is flattened at its end surface. However, other shapes can be selected for the section 62. Essential to the fragment member 59 is the increase in the density of fragments in the direction of firing 61 in comparison with the previously described fragment members 8; 38.

This fragment member 59 can be employed in the full-caliber projectile 1, as well as in the sub-caliber projectile 30.

Figure 5:
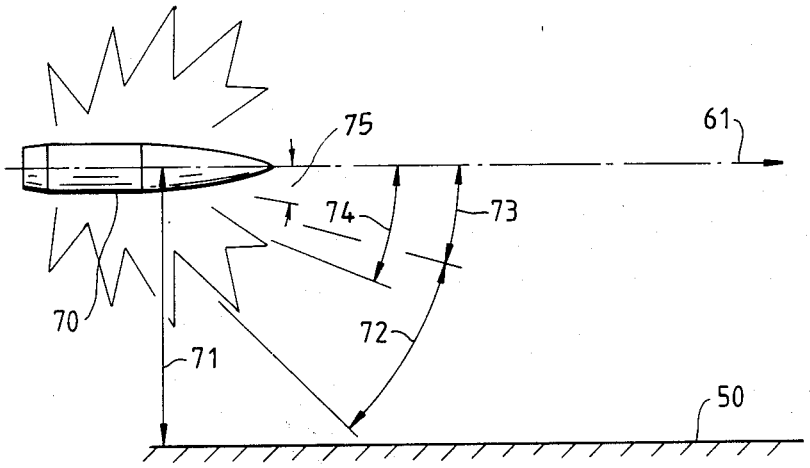
FIG. 5 illustrates, in a diagrammatic manner, the fragmentation effect caused by the projectile of FIG. 4.

Pursuant to FIG. 5, there is clearly ascertainable the effect of the fragment member 59 as shown in FIG. 4 for a sub-caliber projectile 70. The detonation of the projectile 70 over the target area 50 is carried out at a height above ground 71 of approximately 5 meters. In the region 74 there are located the fragments 20 from the fragment member 59. Based on the assumption that the quantity of the balls or spheroids 20, because of the narrowing section 62, is increased by about 20% in comparison with the fragment member 38, this then leads to an increase in the density of fragments in the direction of firing 61, namely within an angular sector 75 of 0° to a maximum of 10°, by about 50%. In the region 72 there are located the fragments 20 which are formed from the projectile body 32. The angle sector 71 subtends about 20°, the angle sector 72 subtends approximately 45°, and an angle sector 73 subtends approximately 50°. At a suitable, essentially known, selective detonation of the explosive 5; 35 illustrated in the FIGS. 1, 3 and 4, the represented fragment sectors are exclusively oriented toward the ground; in essence, directed only towards the target area 50.

What is claimed is:

1. Explosive projectile assembly including a projectile body and a hollow ballistic hood mounted in front of the projectile body; a head end portion of the projectile body being encompassed by said hood; said head end portion having a forwardly extending conical configuration protruding into the interior of said hood; an explosive charge being arranged within said projectile body; a base detonator attached to a tail end of said projectile body; a multiplicity of first preformed fragments embedded in a matrix of a polyurethane foam material being arranged intermediate the head end portion of said projectile body and the ballistic hood so as to at least fill an annulus in the interior of said hood formed intermediate the outer surface of the conical head end portion of the projectile body and the inner wall surface of said hood; and further preformed fragments being embedded in a peripheral wall surface of said projectile body.

2. Explosive projectile as claimed in claim 1, wherein said conical head end portion of said projectile body includes a cylindrical extension protruding into said hood, said first preformed fragments embedded in said matrix forming a fragmentation member having a central cutout conforming to the shape of the head end portion of the projectile body facing said hood and an external shape conforming to the internal wall structure of said ballistic hood.

3. Fragmentation member for a projectile assembly as claimed in claim 2, wherein said fragmentation member is a generally frusto-conical member.

4. Fragmentation member as claimed in claim 3, wherein said fragmentation member has a planar end surface facing the interior space of said hollow ballistic hood; and a foamed plastic material body in front of said fragmentation member being arranged in said hood and contacting against said planar end surface of said fragmentation member.

5. Fragmentation member for a subcaliber projectile assembly as claimed in claim 3, wherein said projectile body has a closed conical end extending into said hollow ballistic hood, said fragmentation member encompassing said conical end and being of a height extending beyond the conical end portion of said projectile body into the interior of said hood by approximately 30% of the external diameter thereof.

6. Fragmentation member as claimed in claim 5, wherein the conical end portion of the projectile body includes a central cylindrical section having a conical tip, and said cylindrical section protrudes into the hood.

7. Fragmentation member as claimed in claim 6, wherein the conical tip of said cylindrical section projects outwardly of the fragmentation member into said hood.

8. Fragmentation member as claimed in claim 1, wherein the projectile assembly comprises a full-caliber projectile.

9. Fragmentation member as claimed in claim 1, wherein the projectile assembly comprises a sub-caliber projectile.

10. Fragmentation member as claimed in claim 4, wherein the ballistic hood possesses a heavier wall thickness in the region containing the fragmentation member than the wall thickness in the region containing the foamed plastic material body.

11. Fragmentation member as claimed in claim 1, wherein said ballistic hood is constituted of steel.

12. Fragmentation member as claimed in claim 1, wherein said first preformed fragments form a fragmentation member of a reducing cross-section within said ballistic hood extending in the direction of firing of said projectile assembly, and a plastic material body being arranged in said hood in front of said fragmentation member.

* * * * *